US006761329B2

(12) United States Patent
Bartels et al.

(10) Patent No.: US 6,761,329 B2
(45) **Date of Patent: *Jul. 13, 2004**

(54) APPARATUS AND METHOD OF PRODUCING ROLLS OF BAGS

(75) Inventors: Willy Bartels, Mönchengladbach (DE); Gert-Arne Magnusson, Ystad (SE); Thomas Holm, Rydsgård (SE); Thomas Leijon, Ystad (SE); Per Anders Hallin, Malmö (SE); Zoltan Darvas, Malmö (SE)

(73) Assignee: FAS Converting Machinery AB, Ystad (SE)

( * ) Notice: Subject to any disclaimer, the term of this patent is extended or adjusted under 35 U.S.C. 154(b) by 87 days.

This patent is subject to a terminal disclaimer.

(21) Appl. No.: 09/920,747

(22) Filed: Aug. 3, 2001

(65) Prior Publication Data

US 2002/0030135 A1 Mar. 14, 2002

Related U.S. Application Data

(63) Continuation-in-part of application No. 09/384,387, filed on Aug. 27, 1999, now Pat. No. 6,364,241.

(51) Int. Cl.[7] ..... B65H 18/10; B65H 18/26; B65H 19/28; B65H 75/24

(52) U.S. Cl. ..... 242/528; 242/531.1; 242/532; 242/547; 242/571.1

(58) Field of Search ..... 242/528, 521, 242/531.1, 532, 532.7, 533.7, 541.3, 541.1, 541.6, 547, 571.1

(56) References Cited

U.S. PATENT DOCUMENTS

| | | | | |
|---|---|---|---|---|
| 789,707 A | | 5/1905 | Bellamy | 242/547 |
| 1,547,683 A | * | 7/1925 | Reid et al. | 242/531.1 |
| 2,157,765 A | | 5/1939 | Lanter | 242/547 |
| 2,449,234 A | | 9/1948 | Knoble | 242/531.1 |
| 3,703,951 A | | 11/1972 | Brockmuller | |
| 3,847,366 A | | 11/1974 | Schmidt et al. | 242/533.7 |
| 3,859,898 A | | 1/1975 | Besserdich et al. | |
| 3,957,220 A | | 5/1976 | Beck et al. | 242/528 |
| 4,000,864 A | | 1/1977 | Kurtz et al. | |
| 4,034,928 A | | 7/1977 | McDonald et al. | |
| 4,063,693 A | * | 12/1977 | Achelpohl et al. | 242/528 |
| 4,436,252 A | | 3/1984 | Burkle et al. | 242/571.1 |
| 4,528,798 A | | 7/1985 | Meier | |

(List continued on next page.)

FOREIGN PATENT DOCUMENTS

| | | |
|---|---|---|
| CH | 663 602 | 7/1988 |
| DE | 37 42 994 | 6/1989 |
| EP | 0 095 790 | 12/1983 |
| EP | 0 595 555 | 5/1994 |
| EP | 0 837 020 | 4/1998 |
| GB | 2 030 969 | 4/1980 |
| WO | WO 96/15039 | 5/1996 |
| WO | WO 97/33744 | 9/1997 |

OTHER PUBLICATIONS

European Search Report dated Jan. 29, 2002 (EP 01 85 0137).

*Primary Examiner*—John M. Jillions
(74) *Attorney, Agent, or Firm*—Smith, Gambrell & Russell

(57) ABSTRACT

In an apparatus and a method of producing a roll of bags, a bag feeding device is arranged to feed bags one by one to a winding device. The winding device includes a rotating spindle which is arranged to engage with each bag separately to wind the bag on it, so as to build a roll of bags in which the bags are unconnected to one another yet firmly held together. The winding device comprises at least two separate winding stations, each winding station being connected to one or more bag feeding devices; and a switch that is arranged upstream of a bag feeding device to direct the bags from one winding station to the other when a roll of bags has been completed in one of the winding stations.

45 Claims, 5 Drawing Sheets

U.S. PATENT DOCUMENTS

| | | | | |
|---|---|---|---|---|
| 4,757,952 | A | 7/1988 | Balzer | |
| 4,944,468 | A | 7/1990 | Damour | 242/571.1 |
| 5,058,820 | A | 10/1991 | Ito et al. | 242/541.3 |
| 5,234,211 | A | 8/1993 | Olexy | |
| 5,291,823 | A | 3/1994 | Kramps | 242/528 |
| 5,362,013 | A | 11/1994 | Gietman, Jr. et al. | |
| 5,377,929 | A | 1/1995 | Gietman, Jr. et al. | 242/521 |
| 5,390,875 | A | 2/1995 | Gietman, Jr. et al. | |
| 5,779,180 | A | 7/1998 | Smedt et al. | 242/528 |
| 5,832,696 | A | 11/1998 | Nagy et al. | 242/541.3 |
| 5,979,820 | A | 11/1999 | Yamada et al. | 242/541.3 |

* cited by examiner

APPARATUS AND METHOD OF PRODUCING ROLLS OF BAGS

CROSS REFERENCE TO RELATED APPLICATIONS

The present application is a continuation-in-part of U.S. Ser. No. 09/384,387 filed Aug. 27, 1999, now U.S. Pat. No. 6,364,241, and which is incorporated herein by reference in its entirety.

FIELD OF THE INVENTION

The present invention relates to the art of winding equipment. More specifically, the invention relates to an apparatus and a method of producing rolls of plastic bags, in which the bags are wound into a roll without being connected to one another. The invention also concerns a winding station.

DESCRIPTION OF THE PRIOR ART

Many different types of winding machines are known for winding pliable strips of material such as plastic bags. One type of apparatus is arranged to wind bags into a roll without the bags being connected to one another. In this apparatus, a bag is separated from a continuous web of bag material having transverse lines of perforations in the boundary between adjacent bags. A leading end of the separated bag is arranged to overlap a trailing end of a preceding bag, thereby building a strand of so-called interleaved bags. This strand of bags is then wound into a roll in a winding device.

A roll-forming apparatus of this kind, disclosed in U.S. Pat. No. 5,377,929, has a tumbler assembly, which is arranged between a feeding device and a winding device. The tumbler device is adapted to receive a continuous web of bag material from the feeding device. By rotation of the tumbler assembly, a bag is separated from the web and arranged to partly overlap a trailing end of the succeeding web fed from the feeding device. The strand of interleaved bags thus formed is fed to the winding device, in which a roll of bags is formed.

U.S. Pat. No. 4,000,864 discloses a roll-forming apparatus in which a gripping device is arranged between a feeding device and a winding device. The gripping device is adapted to grip the leading edge of a separated bag as received from the feeding device, accelerate the separated bag relative to a preceding bag, decelerate the separated bag and place a leading end of the separated bag on a trailing end of the preceding bag. This operation is repeated to form a strand of interleaved bags, which are fed to the winding device.

U.S. Pat. No. 4,034,928 discloses a roll-forming apparatus having a sheet tuck-in means in the form of a blade. In this apparatus, separate bags are fed to the tuck-in means, where a bag is folded by advancing the blade into contact with the bag about midway between its terminal edges. Then a succeeding bag is fed to the tuck-in means, folded and advanced such that it is caught between the terminal edges of the preceding bag. Thus, a strand of interleaved bags is created. This strand is fed to a winding device, in which a roll of bags is formed.

One drawback of the above types of apparatus resides in their inherent mechanical complexity. Thus, the prior-art roll-forming apparatus tend to be expensive, have much down-time and require frequent maintenance. Further, the apparatus often include sophisticated control systems for adequate timing of the feeding and overlapping operations. Expensive and delicate sensors might also be installed to provide the necessary timing signals. Also, the overlapping operation often calls for a periodic and abrupt change in the speed of various feeding mechanisms, leading to increased wear and tear in the machinery.

Further prior art is disclosed in U.S. Pat. No. 5,779,180, WO 97/33744 and DE-A-37 42 994, the latter disclosing a device for producing a stack of plastic bags. The stacking device includes a rotating barrel drum, the periphery of which has a projecting needle. Separated bags are sequentially fed to the barrel drum, where they are threaded onto the projecting needle, thereby creating a stack of overlapping bags on the periphery of the drum. By stopping the drum and retracting the needle, the stack of bags can be transferred to a subsequent discharge device.

In U.S. Pat. No. 4,757,952, a winding device is disclosed in which an endlessly rotating belt is used to feed bags onto a winding core where they are wound into a roll.

All of the above-mentioned winding devices suffer from the disadvantage of having to be stopped for removal of a completed roll of bags before winding of a new roll can begin. This causes interruptions in the production, which, in turn, cause increased costs.

OBJECTS OF THE INVENTION

One object of the invention is to solve or alleviate some or all of the above problems associated with prior art. More specifically, it is an object of the invention to provide a roll-forming apparatus of simple structure, which is capable of winding bags into a roll without the bags being connected to one another and without inflicting any damage to the bags.

Furthermore, the apparatus should cause low wear and tear to the included components.

A further object is to provide a roll-forming apparatus with little need for control and timing in the production of rolls of bags.

Still another object is to provide an apparatus allowing little down-time and high production rates.

An additional object of the invention is to provide an apparatus capable of being included in or operated together with conventional bag-making machines.

A specific object is to provide a new winding station, which is improved over prior art.

Another object of the invention is to provide a method of producing rolls of bags, remedying some or all of the drawbacks discussed above.

SUMMARY OF THE INVENTION

These and other objects and advantages of the invention, which will appear from the description below, are achieved by an apparatus, a winding station and a method as set forth in the independent claims, preferred embodiments and variants being defined in the dependent claims.

The invention is based on the understanding that it is possible to dispense with the arranging of the separated bags in an overlapping fashion before winding them into a roll of bags. Instead, the feeding means is arranged to feed bags one by one to the winding stations. Each winding station includes a rotating spindle, which is arranged to engage with each bag, directly or via bags previously wound thereon, to form the roll of bags in which the bags are unconnected to one another yet firmly held together. This allows a considerably simplified construction of the apparatus. Since the bags are fed one by one to the winding stations, there is no need for tumbling or reciprocating devices manipulating the leading or trailing ends of each bag. This results in a reduced risk of damage to the bags, as well as low wear and tear in the construction itself. Further, since the bags are fed one by one to the winding stations, it is easy to direct the flow of separate bags between different winding stations. This allows high production rates since two or more winding stations can be operated sequentially such that a roll of bags is being formed in one winding station while a finished roll of bags is being discharged from an adjacent winding station.

The apparatus preferably comprises a separation device arranged to separate the bags from a continuous web of bag material with perforations in the boundary between adjacent bags. This provides a rational manner of feeding separate bags to the apparatus.

In one embodiment of the apparatus the separation device includes a first driven pair of rollers for feeding the web, and an engagement means which is arranged upstream of the first pair of rollers, in the feeding direction. The engagement means is operable to engage the web at least intermittently to thereby separate a bag therefrom. This is a practical way of separating bags from the web.

The distance between the engagement means and the first pair of rollers is preferably adjustable to exceed the mutual distance between successive perforations in the web. This provides the possibility of adjusting the separation device to different bag lengths.

The engagement means may include a second driven pair of rollers for feeding the web. In such case, the feeding rate of the first pair of rollers should exceed the web feeding rate of the second pair of rollers. As a result, bags may be separated from the web of bag material without any interruption in the web feeding.

The feeding means of the apparatus according to the invention preferably comprises at least one driven pair of rollers for feeding a bag to the spindle. The bag feeding rate of this pair of rollers essentially corresponds to a web feeding rate of the first pair of rollers of the separation means. This provides a smooth feeding process.

According to one embodiment of the invention, each winding station comprises an abutment means, which is abuttingly arranged on a. major portion of the periphery of the rotating spindle. The bags received from the feeding means are engaged between the abutment means and the periphery of the spindle. This provides a simple way of holding the bags against the spindle.

The abutment means preferably extends over at least ⅔ of the periphery of the spindle. As a result, the bags are securely held against the spindle.

In order to achieve a neatly formed roll of bags, the abutment means is arranged to apply essentially constant force on the roll of bags during formation thereof on the periphery of the spindle.

The abutment means preferably comprises at least one movable endless belt, which is arranged to partly encircle the spindle. This is a mechanically simple way of providing an abutment means.

The belt of the abutment means should be driven at an essentially constant speed in order to feed the bags smoothly onto the spindle.

An effective way of driving the belt of the abutment means is by engagement with the spindle.

In one embodiment of the apparatus, each winding station comprises a guide means arranged to guide the belt during movement thereof. This prevents the belt from moving sideways during movement.

The belt guiding means may comprise a body defining a trench having the shape of an arc. The belt is received in the trench in which perforations are provided in a bottom surface. The perforations are connected to a gas supply device to provide a gas layer between the belt and the bottom surface. The trench prevents the belt from slipping and the gas layer reduces friction between the belt and the trench.

The bottom surface of the trench is preferably formed on a peripheral portion of a cylinder, which is fixedly connected to a support of the winding station. Two opposite wall surfaces of the trench are formed by portions of gables, which are arranged at opposite ends of the cylinder. The fixed connection between the cylinder and the support: of the winding station simplifies the connection of the cylinder to the gas supply.

In one embodiment, the gables are journaled for free rotation relative to the cylinder, thus reducing friction between the belt and the trench.

Each winding station may comprise haul-in means arranged to engage a leading end of a bag with the rotating spindle. This makes for a secure formation of a roll of bags.

In one embodiment of the apparatus of the invention, a first backup roller is arranged against the belt upstream of the rotating spindle, as seen in the direction of belt movement, and a second belt backup roller is arranged against the belt upstream of the rotating spindle, the backup rollers guiding the belt around the rotating spindle. In a region between the first belt backup roller and the spindle, the belt forms a bag haul-in means. As a result, the belt is securely guided around the spindle and an effective haul-in means is provided.

Preferably, at least part of the feeding means is movable relative to the winding station such that, during formation of a roll of bags on the spindle, an essentially constant angle of attack is achieved between a leading end of a bag fed thereto and the haul-in means. This minimizes changes in the flow path of the bags during the roll-forming process.

In one embodiment of the invention, the second belt backup roller has a smaller diameter and is arranged closer to the rotating spindle than the first belt backup roller. The inlet opening defined by the first and second backup rollers can thus be kept small, ensuring that the leading ends of the bags follow the periphery of the spindle.

The first and second belt backup rollers and at least part of the feeding means may be arranged at a fixed mutual distance on a movable element, an essentially constant distance being maintained between the movable element and the roll of bags during formation thereof. This provides a way of maintaining an essentially constant force on the roll of bags during the roll-forming process.

According to a preferred embodiment, the rotating spindle is essentially circular in cross section and has a variable diameter. Thus, by reducing the diameter of the spindle, removal of a roll of bags can be facilitated.

An effective way of providing a variable diameter of the spindle is to arrange an interior chamber inside the spindle. The diameter can be varied by changing a gas pressure in the chamber. The change of diameter can also be achieved mechanically.

Further, the spindle may comprise an elongate body, a tube means of flexible material arranged in a number of turns around the body, and a protective sheet covering the tube means and forming a periphery of the spindle. By changing the gas pressure in the interior chamber of the spindle, the tube means effects a change of the diameter of the spindle. The protective sheet provides a smooth surface.

According to a particular aspect of the invention, an improved winding station is provided.

The winding station of the invention comprises a switch means which makes it possible to direct bags into the winding station for forming a roll of bags and to direct the bags past the winding station if the roll of bags in the winding station is completed. In this manner, bags can be directed to another winding station in a series of winding stations while a completed roll is being removed from the first winding station. This means that interruptions in the production are avoided.

According to one embodiment, the winding station of the invention is adapted to receive bags from a feeding means comprising a conveyor belt, and the switch means comprises means for diverting the conveyor belt into contact with the winding station. The diversion of the conveyor belt is a simple way of directing the bags into the winding station.

The switch means preferably comprises a pivotable arm, which is connected to a roller. The arm is pivotable to bring the roller into engagement with the conveyor belt for diverting the conveyor belt upwards. This arrangement makes it possible to easily switch between winding stations when a roll of bags is completed in one winding station.

In a preferred embodiment, the winding station is disposed to be arranged above the conveyor belt, giving the possibility of arranging several winding stations in a row.

The winding station may comprise a haul-in means arranged to move a bag from the conveyor belt into the winding station and to engage a leading end of the bag with the rotating spindle. Thus, a secure transfer of bags from the feeding means onto the spindle is achieved.

According to a further embodiment of the invention, the haul-in means is arranged to move the bag from the conveyor belt into the winding station in a direction which is perpendicular to a feeding direction of the conveyor belt. This makes it possible to easily arrange a number of winding stations above the conveyor belt.

The haul-in means preferably comprises an endless belt, which is arranged to be brought into contact with the conveyor belt when the conveyor belt is diverted into contact with the winding station. This is a mechanically simple way of providing a haul-in means.

According to another aspect of the invention an improved winding apparatus is provided, comprising at least two of the winding stations of the invention.

According to the method of the invention, bags are wound into a roll in one of at least two winding stations, without being connected to one another, fed one by one to a rotational means and wound thereon. When one roll of bags is completed in one of the at least two winding stations, the bags are directed to another of the winding stations. This provides an effective way of forming rolls of bags, as it makes it possible to remove a finished roll while another is being formed.

BRIEF DESCRIPTION OF THE DRAWINGS

For exemplifying purposes, the invention will now be described in more detail with reference to the accompanying drawings, which schematically illustrate a currently preferred embodiment of the invention and in which.

DESCRIPTION OF EMBODIMENTS OF THE INVENTION

Figure 1:
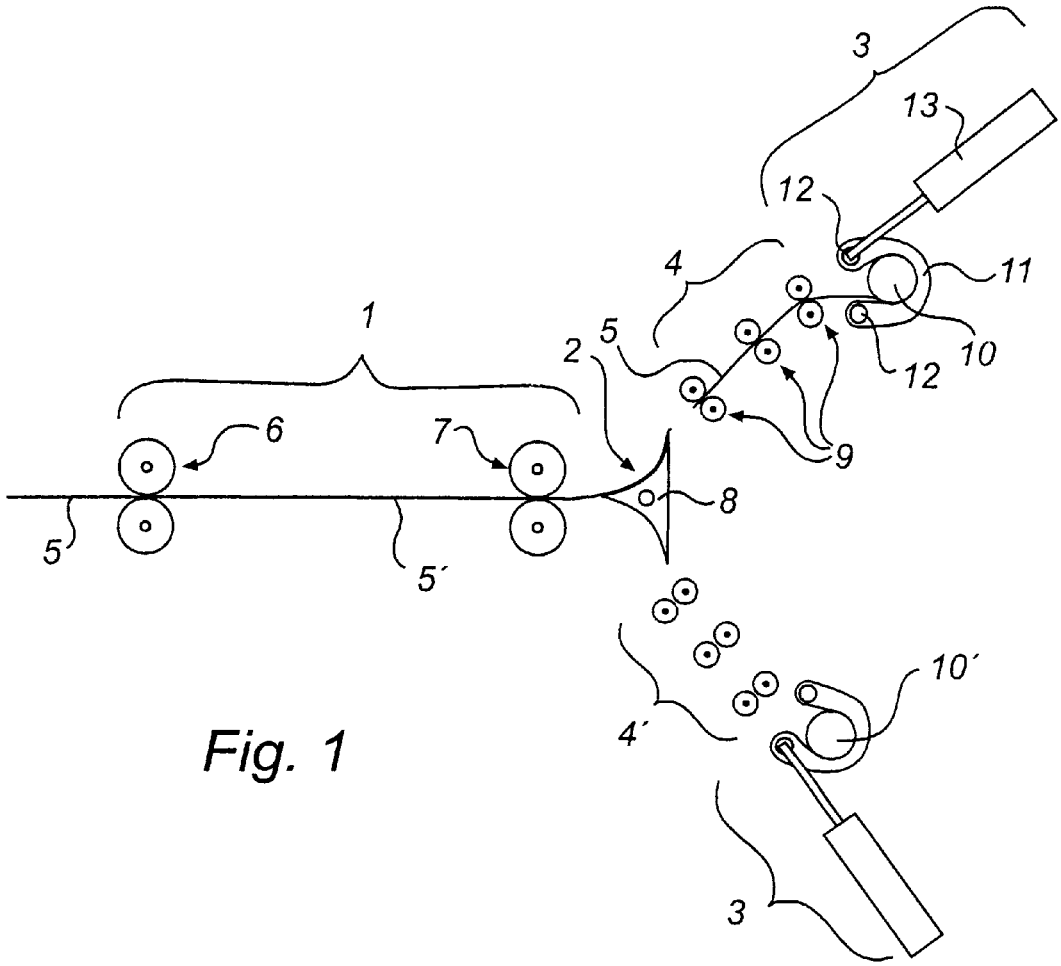
FIG. 1 is a side view of a roll-forming apparatus according to a first aspect of the invention.

FIG. 1 provides a schematic overview of an apparatus according to a first embodiment of the invention. The apparatus comprises a combined feeding and separating unit 1, a switch unit or switch means 2, and first and second winding stations 3, 3'. Between the switch unit 2 and each winding station 3, 3"there is provided a bag feeding device or bag feeding means 4, 4'.

The roll-forming apparatus receives a web 5 of bag material, for example from a bag-making machine. In such a web 5, bags are defined by welding lines and perforations, in a manner known per se.

The feeding and separating unit 1 comprises a driven pair of inlet rollers 6 feeding the web 5 at a first speed. Downstream of the inlet rollers 6, there is provided a driven pair of outlet rollers 7 feeding the web at a second speed, which is higher than the first speed. Thus, when the leading edge of the web 5 is engaged with the outlet rollers 7, the web 5 will be stretched such that a bag 5' is torn from the web 5 along a perforation therein. Thus, separation is achieved without any interruption in the web feeding rate. Further, the separation unit 1 also automatically provides a spacing between each separated bag 5' and the web 5, since the bag 5' is accelerated by the outlet rollers 7. The distance between the inlet and outlet rollers 6, 7 should be adjustable in relation to the length of the bags 5'. Preferably, this distance should equal or exceed the length of each bag 5'.

The switch unit 2 comprises a wedge 8, the tip of which is directed towards the separation unit 1. The wedge 8 is slightly rotatable such that its tip is moved sideways a small distance to guide the flow of separated bags 5' from the separation unit 1 to the first or to the second winding station 3, 3'.

The feeding device 4 comprises a number of sequential pairs of rollers 9, preferably driven at the same feeding rate as the outlet rollers 7 of the separation unit 1 or at a slightly higher rate.

The winding station 3 comprises a rotatable winding spindle 10. The separated bags 5' are fed one by one to the spindle 10 and are overlappingly arranged on the periphery thereof. Thus, the bags 5' are successively engaged with the spindle 10, on which a roll of bags is built up. A belt 11 is arranged to encircle a major portion of the periphery of the spindle 10 in order to hold the bags 5' against the periphery of the spindle 10. A number of backup rollers 12 are arranged to guide the belt 11 in an endless loop around the winding spindle 10. A belt tensioning device 13 is connected to one of the backup rollers 12. As the number of bags wound onto the spindle 10 is increased, the belt tensioning device 13 adjusts the tension in the belt 11 to be essentially constant so that an essentially constant force is applied to the bags on the spindle 10. In one preferred embodiment with automatic tension adjustment, the belt tensioning device comprises a piston/cylinder arrangement in which the cylinder contains a gas held at a constant pressure. Thus, the gas provides a constant backing pressure producing a force acting on the piston, which in turn is connected to a backup roller 12 in the winding station 3. The second winding station 3' is identical to the first winding station 3 and a detailed description thereof is therefore not necessary.

Figure 2:
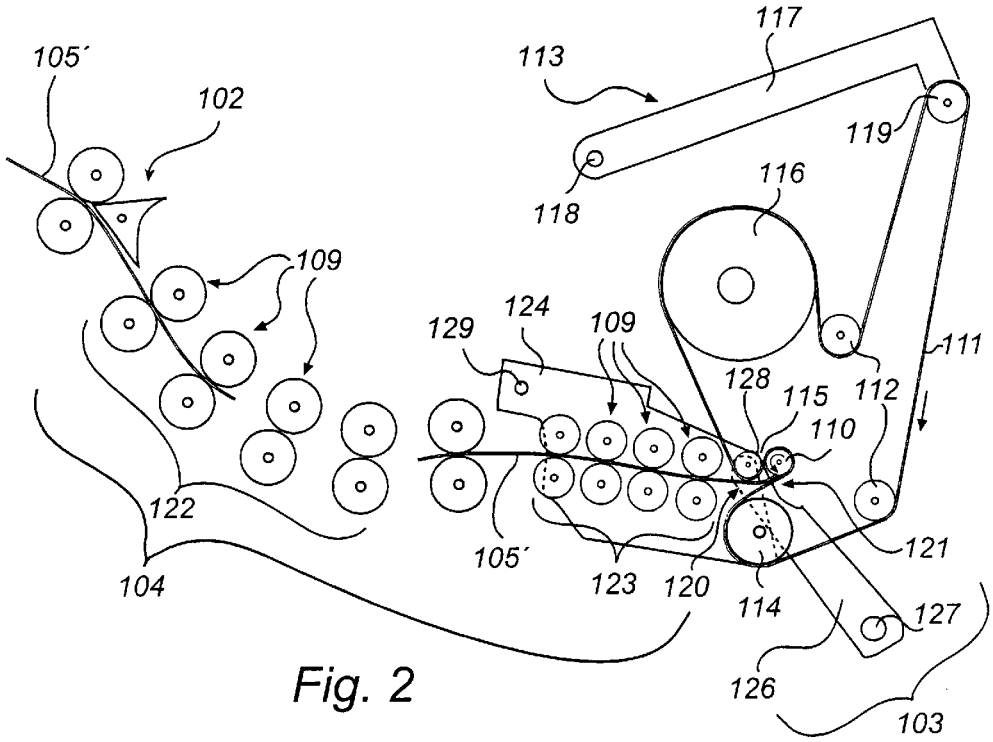
FIG. 2 is a detailed side view of the apparatus shown in FIG. 1, the apparatus being in an initial stage in producing a roll of separate bags.
Figure 3:
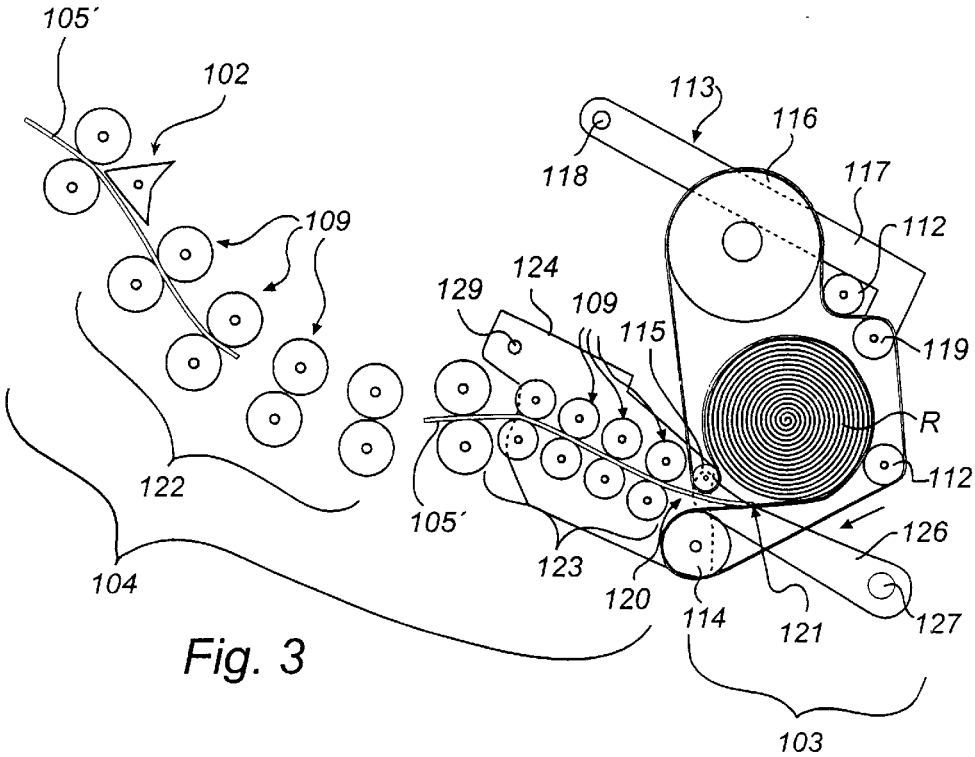
FIG. 3 is a detailed side view of the apparatus shown in FIG. 1, the apparatus being in a final stage in producing a roll of separate bags.

FIGS. 2 and 3 show in more detail an embodiment of the winding station, here designated 103, and the associated feeding means, here denominated 104, in an initial and final stage, respectively, in producing a roll R of bags. A second winding station of the same kind is foreseen but not shown in FIGS. 2 and 3. The switch means 102 directs the bags 105' to one of the winding stations.

The winding station 103 is formed around the rotatable spindle 110. The belt 111, preferably made of a material such as rubber, is arranged in an endless loop extending over a number of backup rollers 112, 114, 115 and a belt guide means 116. Preferably, the surfaces of the belt 111 are flat.

The belt tensioning device 113 comprises a tension lever 117 which is pivotable at one end around a pin 118 attached to a frame (not: shown) of the winding station 103. At the other end, the tension lever 117 carries a roller 119, which is arranged within the endless loop in contact with the belt 111. The tension lever 117 is connected to a member (not shown) applying tractive forces thereto, such as the piston/cylinder arrangement described above. A spring arrangement may also be used to this end.

The winding station 103 comprises an inlet backup roller 114 and an outlet backup roller 115, with respect to the direction of belt movement around the periphery of the spindle 110. The inlet and outlet backup rollers 114, 115 define an inlet opening 120 through which bags 105' are being fed to the spindle 110. This inlet opening 120 should be as small as possible to ensure that the leading ends of the bags 105' follow the periphery of the spindle 110. Therefore, the outlet backup roller 115 has a small diameter. A loop portion 121 extending between the inlet backup roller 114 and the spindle 110 drives the leading edge of each bag 105' into engagement with the spindle 110, or the previous bags 105' wound thereon.

The feeding means 104 comprises first and second feeding assemblies 122, 123, each comprising a number of sequential driven pairs of rollers 109. The second feeding assembly 123 is arranged on a holder 124 together with the inlet and outlet backup rollers 114, 115. A control lever 126 is pivotable around a pin 127 attached to the frame (not shown) of the winding station 103. A distal end of the control lever 126 is rotatably attached to a first pin 128 of the holder 124. The outlet backup roller 115 is arranged for free rotation on this first pin 128. The holder 124 has a second pin 129, which is pivotably and slidably received in a bearing (not shown) attached to the frame (not shown). The control lever 126 is biased towards the spindle 110 such that the outlet backup roller 115 is always applied to the periphery of the bags 105' being wound on the spindle 110, thereby directing the leading end of the outermost bag around the spindle 110.

The arrangement of the inlet and outlet backup rollers 114, 115 together with the second feeding assembly 123 on a common holder 124, minimises the relative movement between the inlet opening 120 and the facing end of the second feeding arrangement 123. Thus, an essentially constant angle of attack is achieved between the leading end of each bag 105' and the spindle 110 throughout the roll-forming operation. Further, relative movement is minimised between the first feeding assembly 122 and the facing end of the second feeding assembly 123, thereby minimising changes in the flow path of separated bags 105' during the roll-forming operation.

Preferably, the speed of the belt 111 is kept essentially equal to or slightly higher than the feed rate of the second feed assembly 123 throughout the roll-forming operation, to avoid any stretch or slack in the bag 105' as it is brought into engagement between the belt 111 and the spindle 110. It is also preferred that the spindle 110 be connected to a drive means (not shown), such as an electrical motor, and that the belt 111 be driven by engagement with the spindle 110. With such a driven spindle 110, each bag 105' wound onto the spindle 110 will be automatically tightened by a slight slipping action occurring between the belt 111 and the outermost bag 105' in the roll R. To maintain the speed of the belt 111 essentially equal to the feeding rate of the second feed assembly 123, the rotating speed of the spindle 110 has to be reduced as the roll R is growing in diameter thereon. For example, a conventional potentiometer (not shown) could be connected to the control lever 126 to monitor the radius of the roll R, and the speed of the spindle 110 could be adjusted accordingly.

Figure 4:
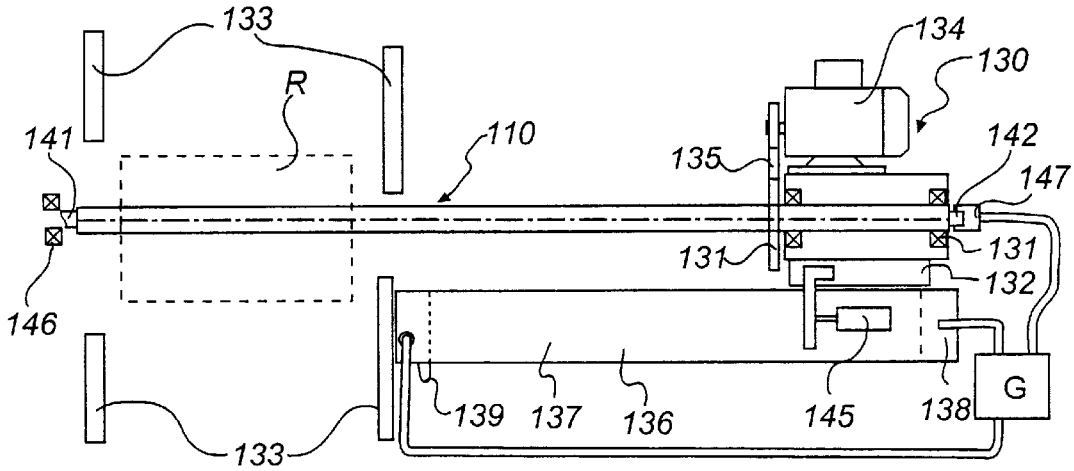
FIG. 4 is an elevation of a winding station of the apparatus shown in FIGS. 2–3.

An embodiment of the winding spindle 110 will be further described with reference to FIGS. 4–5. FIG. 4 is a side view of the spindle 110 and an associated driving means 130. For reasons of clarity, the belt 111 is removed, and the position of a roll R of bags is indicated with dotted lines.

The spindle 110 extends through bearings 131 mounted in a block 132, which is carried by the frame 133 of the winding station 103. An electric motor 134 is arranged on the block 132 to rotate the spindle 110 via a belt drive 135. The spindle 110 can be displaced from the roll-forming position of FIG. 4 to a discharge position (not shown) in which the roll R is positioned outside the frame 133. In the embodiment of FIG. 4, the block 132 is attached to a piston 136 enclosed in a main cylinder 137, which is connectable to a gas supply device G. The displacement of the spindle 110 is effected by increasing the gas pressure at the respective end 138, 139 of the main cylinder 137.

The spindle 110 should preferably have a smooth and circular circumferential surface so that the belt 111, and the bags 105', can be firmly arranged around a major portion thereof. However, such a smooth surface makes it difficult to remove the finished roll R of bags, since the bags tend to adhere to the surface.

Figure 5:
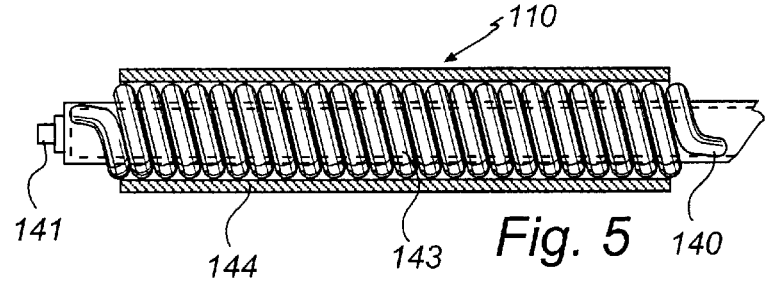
FIG. 5 is an elevation, partly in section, of a winding spindle of the winding station of FIG. 4.

This problem is solved in the embodiment shown in FIG. 5, in which the spindle 110 is essentially circular in cross section and has a variable diameter. The spindle 110 comprises an elongate hollow pipe 140, preferably of metal, the ends of which are sealed and provided with an outlet and an inlet valve 141, 142, respectively. A tube 143 of flexible material, such as a silicon material, is arranged in several turns around the periphery of the pipe 140, one end of the flexible tube 143 being communicated with the interior of the pipe 140 and the other end being closed. A sheet 144, preferably of a flexible material, e.g. a plastic material, is arranged around the turns of flexible tube 143 to provide a smooth circumferential surface. The longitudinal ends of the sheet 144 are arranged to overlap without being physically connected. Thus, by changing a gas pressure within the spindle 110, the diameter of said spindle 110 can be controlled. It is to be understood that only part of the spindle 110 needs to be provided with such a controllable diameter.

The operation of the above spindle 110 will now be described with reference to FIG. 4. When a roll-forming operation has been completed, the spindle 110 is first moved a short distance away from the discharge position by means of the cylinder 137 to disengage a bearing 146. The bearing 146 is folded away by means of hinges (not shown). The spindle is advanced, by pressurizing one end 138 of the main cylinder 137, so that the roll R is brought outside the frame 133. On advancing the spindle 110, its outlet valve 141 is engaged with a stop means (not shown) so that gas is released from the spindle 110, thereby decreasing its diameter. Due to the reduced diameter of the spindle 110, the roll R of bags is easily removed. Then, the spindle is retracted by pressurizing the opposite end 139 of the main cylinder 137. The bearing 146 is returned to its original position and by means of a secondary gas-actuated piston 145 connecting the block 132 to the main cylinder 137 the spindle is returned to engagement with the bearing 146. When the spindle 110 is returned to the roll-forming position its inlet valve 142 is engaged with a connector 147 of a gas supply device G. Thus, the diameter of the spindle 110 is again increased before a first bag 105' is wound thereon.

In order to prevent the outermost bag of the roll R from falling off, the spindle 110 can be slowly rotated during the above operation.

A wide belt, which is being driven over rollers in an endless loop, has a tendency to move sideways on the rollers. Thus, after a few revolutions of the belt in the endless loop, the belt tends to fall off. To overcome this problem, the winding station 103 comprises a belt guide means 116, as shown in FIGS. 2–3, which will be further described with reference to FIG. 6. In the belt guide means 116, a large-diameter hollow cylinder 150 is coaxially arranged on a pipe 151 and secured against rotation by means of a pin 152 extending through the pipe 151. Two gables 153 are arranged adjacent to a respective end of the cylinder 150. Each gable 153 is connected to a bearing 154 fixed to the pipe 151. The extremities 155 of the gables 153 project beyond the peripheral surface 156 of the cylinder 150, thereby forming a chute or a trench 157 in which the belt 111 is to be received. Each extremity 155 is formed to provide a first surface 158, which is level with the peripheral surface 156, and a second surface 159, which is inclined away from the first surface 158 and forms a side wall of the trench 157.

Preferably, a gas layer is provided between the belt 111 and the peripheral surface 156 of the cylinder 150. To this end, the pipe 151 is connected to a gas supply device G and the wall of the pipe 151 has openings communicating the interior of the pipe 151 with the interior of the cylinder 150. Further, the peripheral surface 156 is provided with holes or perforations P, through which gas from the gas supply device is ejected.

The large-diameter cylinder 150 with journaled gables 153 effectively prevents the moving belt 111 from climbing off the cylinder 150, and provides low friction between the gables 153 and the belt 111. Friction is further reduced by the gas layer between the belt 111 and the peripheral surface 156. The cylinder 150 is preferably stationary, since this simplifies the interconnection between the pipe 151 and the cylinder 150.

Figure 7:
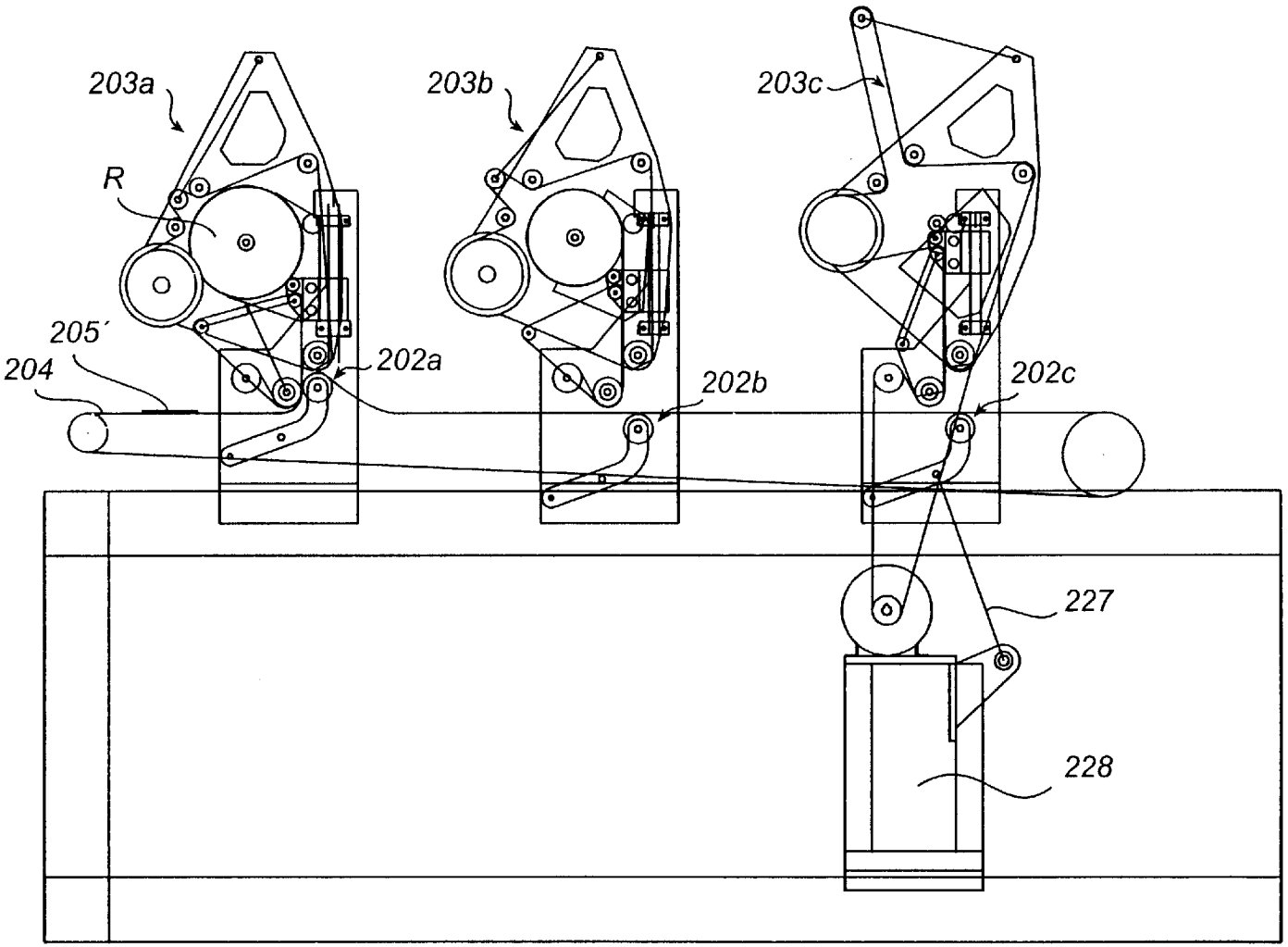
FIG. 7 is a side view of an apparatus according to a second aspect of the invention.

According to another aspect of the invention, an alternative winding apparatus is provided. Two or more winding stations 203*a*, 203*b*, 203*c* may be arranged in series, as shown in FIG. 7. Here, three winding stations 203*a*, 203*b*, 203*c* are arranged above an endless conveyor belt 204. Switch means 202*a*, 202*b*, 202*c* are included in each winding station 203*a*, 203*b*, 203*c*.

The structure of the winding station is similar to that of the winding station described in conjunction with FIGS. 2–6. Similar parts have been given numerals similar to those of FIGS. 2–6.

Figure 8:
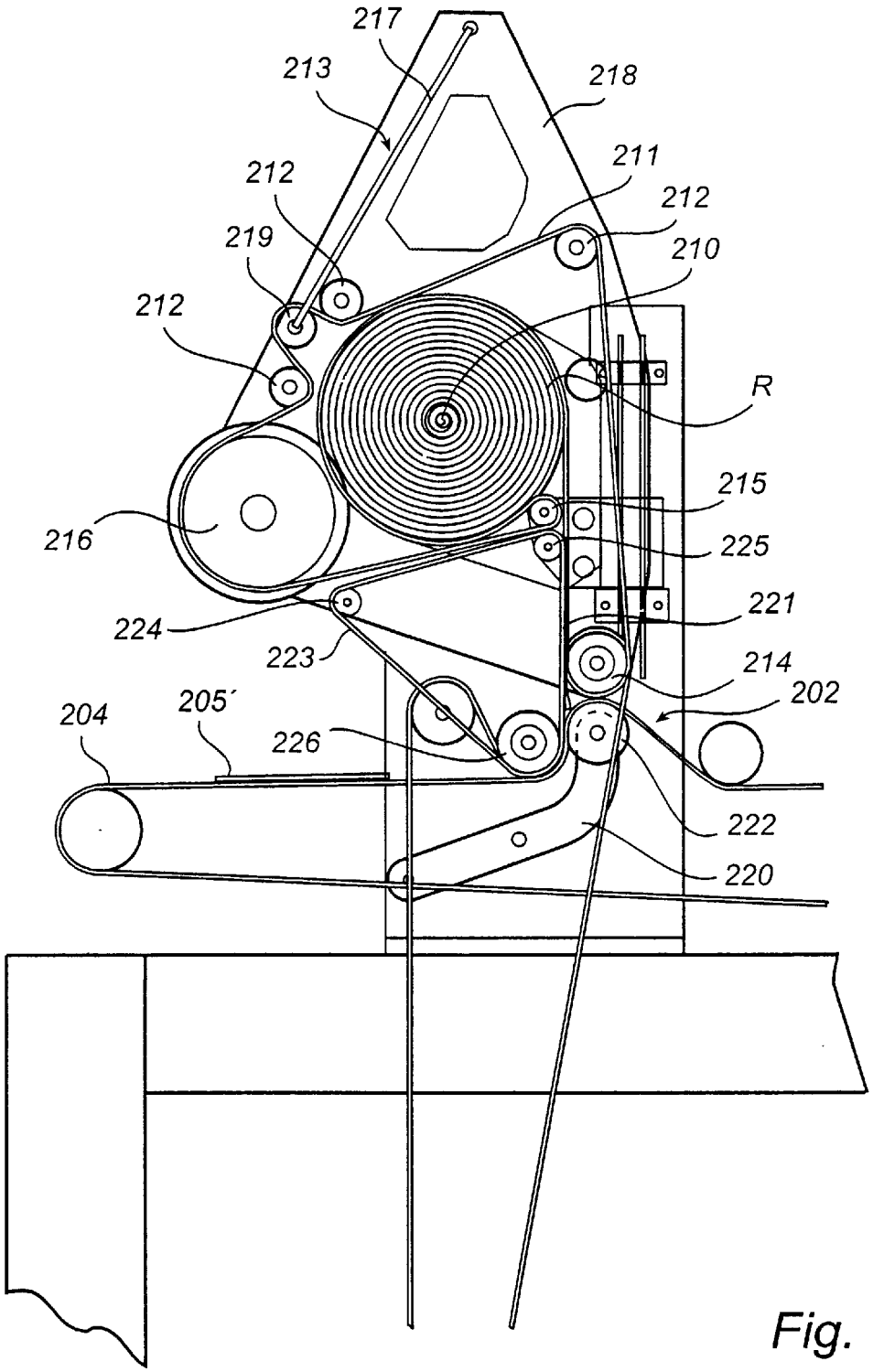
FIG. 8 is a side view of a winding station of the apparatus shown in FIG. 7.

As can be seen from FIG. 8, the winding stations 203*a*, 203*b*, 203*c* each have a tiltable frame 218, a rotating spindle 210, a first belt 211, which is arranged around a number of rollers 212 and driven by a motor 228, a belt tensioning device 213, a second belt 223 which is arranged around three rollers 224, 225, 226 and driven by the motor 228, and a switch means 202.

The winding stations 203*a*, 203*b*, 203*c* receive bags that are separated from a web of bag material using a separation unit, such as the one shown in FIG. 1. However, the distance between the inlet rollers 6 and the outlet rollers 7 need not be adjustable. The separated bag 205' is fed onto the conveyor belt 204 on which it is transported to one of the winding stations 203*a*, 203*b*, 203*c*. While being transported on the conveyor belt 204 the bag 205' is retained thereon by means of static. The bag 205' may also be retained using vacuum or bands. The conveyor belt 204 is made of an elastic material, e.g. rubber.

The switch means 202*a*, 202*b*, 202*c* is used to direct the bag 205' towards one of the winding stations 203*a*, 203*b*, 203*c*. Each switch means 202*a*, 202*b*, 202*c* consists of a pivotally mounted arm 220, which is connected to a roller 222. In an inactive stage, the roller 222 is placed under the top part of the conveyor belt 204. When the switch means 202*a*, 202*b*, 202*c* is activated, a cylinder 227 pushes the arm 220 to bring the roller 222 into contact with the top part of the conveyor belt 204 and divert the conveyor belt 204 upwards. This operation directs the bag 205' upwards towards the corresponding winding station 203*a*, 203*b*, 203*c*. The conveyor belt 204 is preferably diverted so that the feed direction is diverted perpendicularly to the original feed direction. The second belt 223 is placed around three rollers 224, 225, 226, forming a triangular loop with one side being essentially vertical. When the conveyor belt is diverted by the switch means, it is brought into contact with the second belt 223, which engages the bag 205' and moves it upwards into engagement with the first belt 211.

The second belt 223 and the part of the first belt between the inlet backup roller 214 and the spindle 210 form a haul-in means 221. The haul-in means 221 moves the bag 205' from the conveyor and feeds the bag 205' onto the spindle 210 on whose periphery it is overlappingly arranged. The first belt 211 encircles a major portion of the spindle 210 in order to hold the bags 205' against the periphery thereof.

The first belt 211 is placed around a number of backup rollers 212, which are mounted on a frame 218 and which guide the belt in an endless loop around the spindle 210. The belt tensioning device 213 consists of a lever 217, which is pivotably connected at one end to the tiltable frame 218. At the other end, the lever 217 is connected to a roller 219. Approximately midway along the lever 217 a cylinder (not shown) is connected between the lever 217 and the frame 218. The first belt 211 is placed around the roller 219. The lever 217 is pivoted by means of the cylinder, changing the position of the roller 219 relative to the backup rollers 212, thus changing the shape of the loop formed by the first belt. This provides a way of applying an essentially constant force on the bags 205' on the spindle 210. Instead of the first belt 211 and the second belt 223, pairs of rollers could also be used, such as the ones described in connection with FIG. 1.

Figure 6:
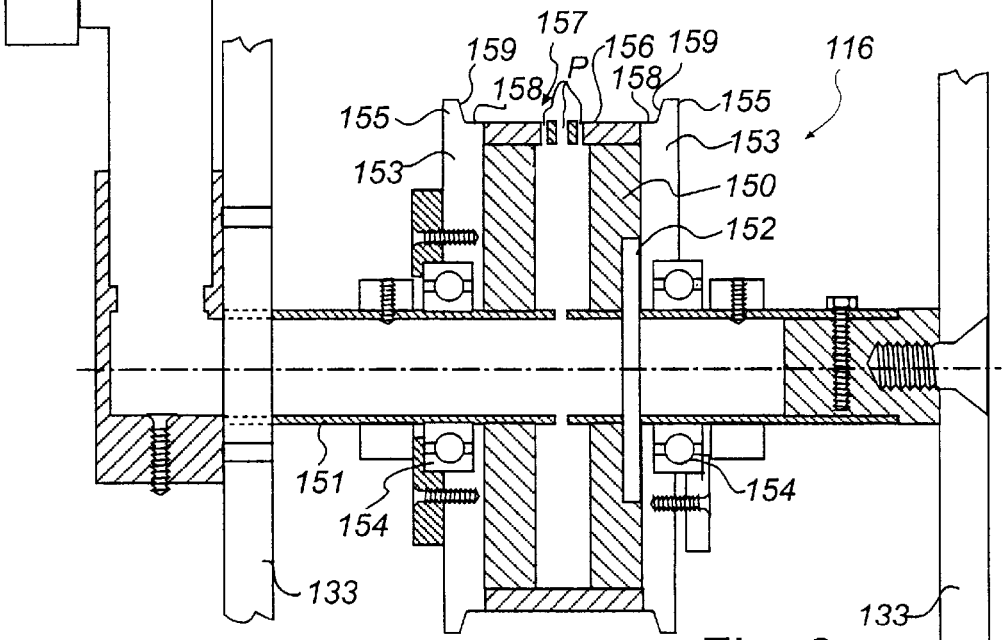
FIG. 6 is an elevation, partly in section, of belt guide means of the apparatus shown in FIGS. 2–3.

In order to prevent the first belt 211 from moving sideways on the rollers, it is arranged around a belt guide means 216 of the same kind as the belt guide means 116 shown in FIG. 6.

The rotating spindle 210 has a variable diameter and is of the same kind as the spindle 110 described in conjunction with FIG. 5.

When a roll of bags is completed in one of the winding stations 203*a*, 203*b*, 203*c* the corresponding arm 220*a*, 220*b*, 220*c* is lowered, so that the roller 222 releases the conveyor belt 204. Instead the arm 220 of the switch means 202*a*, 202*b*, 202*c* of one of the other winding stations 203*a*, 203*b*, 203*c* is raised, thus putting the roller 222 into engagement with the top part of the conveyor belt 204 and diverting the conveyor belt 204 upwards. A new roll is thereby started in the corresponding winding station 203*a*, 203*b*, 203*c*. While a roll is formed in one of the winding stations 203*a*, 203*b*, 203*c*, the completed roll may be removed to prepare the winding station for the next operation. The arrangement of three winding stations 203*a*, 203*b*, 203*c* in one roll-forming apparatus provides ample time for removal of completed rolls and for the necessary adjustments and servicing of the winding stations 203*a*, 203*b*, 203*c* without interruptions in the production. The arrangement of the winding stations 203*a*, 203*b*, 203*c* makes it possible to use as many winding stations as desired.

It is to be understood that various alterations, modifications and/or additions may be introduced into constructions and parts previously described without departing from the spirit or ambit of the invention as defined in the following claims. For example, a bellow means can be incorporated in the spindle instead of the flexible tube to provide the desired radial expansion and contraction. Alternatively, a spring may be provided which changes its diameter on elongation and compression. It should also be understood that a plurality of narrow belts could be used instead of a single wide belt.

The invention is in particular applicable to plastic bags, but it is understood that the inventive concept can be used for other materials.

What is claimed is:

1. An apparatus for producing a roll of bags, in which bags are wound into a roll without being connected to one another, the apparatus comprising:

bag feeding means;

winding means disposed to receive the bags from the feeding means, the winding means including driven rotational means arranged to engage with the bags and produce the roll of bags, the bag feeding means being arranged to feed the bags in a spaced, one by one corner to the rotational means, said winding means comprising at least two separate winding stations, and the rotational means comprising a driven rotating spindle in each winding station, each winding station being connected to a bag feeding means; and switch means arranged upstream of the feeding means to direct the bags to another of said at least two winding stations when a roll of bags has been completed in one of the winding stations.

2. An apparatus as set forth in claim 1, wherein the switch means comprises a wedge, the tip of which is directed towards an upstream bag separation unit, the wedge being rotatable such that its tip is moved sideways a small distance to guide the flow of separated bags from the separation unit to one of the winding stations.

3. An apparatus as set forth in claim 1, further comprising a separation device arranged to separate the bags from a continuous web of bag material having perforations or a weakened region in the boundary between adjacent bags.

4. An apparatus as set forth in claim 3, wherein the separation device includes a first driven pair of rollers for feeding the web, and an engagement means which is arranged upstream of the first pair of rollers, in the feeding direction of the web, and is operable to at least intermittently engage the web to thereby separate a bag therefrom.

5. An apparatus as set forth in claim 4, wherein the distance between the engagement means and said first pair of rollers is adjustable to exceed the mutual distance between successive perforations or weakened regions in the web.

6. An apparatus as set forth in claim 4, wherein the engagement means includes a second driven pair of rollers for feeding the web, and wherein a web feeding rate of the first pair of rollers exceeds a web feeding rate of the second pair of rollers.

7. An apparatus as set forth in claim 4, wherein the bag feeding means comprises at least one driven pair of rollers for feeding a bag to the spindle, and wherein a bag feeding rate of said pair of rollers essentially corresponds to a web feeding rate of the first pair of rollers of the separation device.

8. An apparatus as set forth in claim 1, wherein each winding station comprises an abutment means which is abuttingly arranged on a major portion of the periphery of the rotating spindle, and wherein the bags received from the bag feeding means are engaged between the abutment means and the periphery of the spindle.

9. An apparatus as set forth in claim 8, wherein the abutment means extends over at least ⅔ of the periphery of the spindle.

10. An apparatus as set forth in claim 8, wherein the abutment means is arranged to apply essentially constant force on the roll of bags during formation thereof on the periphery of the spindle.

11. An apparatus as set forth in claim 8, wherein the abutment means comprises at least one movable endless belt, which is arranged to partly encircle the spindle.

12. An apparatus as set forth in claim 11, wherein the belt is driven at an essentially constant speed.

13. An apparatus as set forth in claim 11, wherein the belt is driven by engagement with the spindle.

14. An apparatus as set forth in claim 11, wherein each winding station comprises a guide means arranged to guide the belt during movement thereof.

15. An apparatus as set forth in claim 14, wherein the belt guiding means comprises a body defining a trench having the shape of an arc, the belt being received in the trench, and wherein perforations are provided in a bottom surface of the trench, said perforations being connected to a gas supply device to provide a gas layer between the belt and the bottom surface.

16. An apparatus as set forth in claim 15, wherein the bottom surface is formed on a peripheral portion of a cylinder which is fixedly connected to a support of the winding station, and wherein two opposite wall surfaces of the trench are formed by portions of gables which are arranged at opposite ends of the cylinder.

17. An apparatus as set forth in claim 16, wherein the gables are journaled for free rotation relative to the cylinder.

18. An apparatus as set forth in claim 11, further comprising a first belt backup roller which is arranged against the belt upstream of the rotating spindle, as seen in the direction of belt movement, and a second belt backup roller which is arranged against the belt downstream of the rotating spindle, the first and second belt backup rollers guiding the belt around the rotating spindle, and wherein the belt, in a region between the first belt backup roller and the spindle, forms a bag haul-in means of the winding station.

19. An apparatus as set forth in claim 18, wherein the second belt backup roller has a smaller diameter and is arranged closer to the rotating spindle than the first belt backup roller.

20. An apparatus as set forth in claim 18, wherein the first and second belt backup rollers and at least part of the bag feeding means are arranged at a fixed mutual distance on a movable element, an essentially constant distance being maintained between the movable element and the roll of bags during formation thereof.

21. An apparatus as set forth in claim 1, wherein each winding station comprises a haul-in means arranged to engage a leading end of a bag with the rotating spindle.

22. An apparatus as set forth in claim 21, wherein at least part of the bag feeding means is movable relative to the winding station such that, during formation of a roll of bags on the spindle, an essentially constant angle of attack is achieved between a leading end of a bag fed thereto and the haul-in means.

23. An apparatus as set forth in claim 1, wherein the rotating spindle is essentially circular in cross section and has a variable diameter.

24. An apparatus as set forth in claim 23, wherein the spindle has an interior chamber which is connected to a gas supply device, and wherein the diameter of the spindle is varied by changing a gas pressure in the chamber.

25. An apparatus as set forth in claim 24, wherein the spindle comprises an elongate body, a tube means of flexible material arranged in a number of turns around the body, and a protective sheet covering the tube means and forming a periphery of the spindle.

26. An apparatus as set forth in claim 1 wherein said switch means is arranged so as to provide for continuous operation of said feeding means during a changeover from a first to a second winding station.

27. A winding station for producing a roll of bags, in which bags are wound into a roll without being connected to one another, the winding station being disposed to receive bags from a bag feeding means and said winding station including driven rotational means arranged to engage with the bags and produce the roll of bags, and said winding station including switch means adapted to direct bags into the winding station for receipt by said driven rotational means and formation of a roll of bags, and to direct bags out away from the winding station if the roll of bags in the winding station is completed.

28. A winding station according to claim 27, wherein the switch means comprises means for diverting a conveyor belt of the bag feeding means into contact with the winding station.

29. A winding station according to claim 28, wherein the diverting means comprises a pivotably mounted arm connected to a roller, the arm being pivotable to bring the roller into engagement with the conveyor belt for diverting the conveyor belt upwards.

30. A winding station according to claim 28, being disposed to be arranged above the conveyor belt.

31. A winding station according to claim 28, further comprising haul-in means arranged to move a bag from the conveyor belt into the winding station and to engage a leading end of a bag with the rotational means.

32. A winding station according to claim 31, wherein the haul-in means is arranged to move the bag from the conveyor belt into the winding station in a direction perpendicular to a feeding direction of the conveyor belt.

33. A winding station according to claim 31, wherein the haul-in means comprises a back-up belt, which is arranged to be brought into contact with the conveyor belt when this is diverted into contact with the winding station.

34. An apparatus for producing a roll of bags, in which bags are wound into a roll without being connected to one another, comprising at least two winding stations according to claim 27.

35. An apparatus according to claim 34 further comprising feeding means for feeding bags to said at least two winding stations.

36. An apparatus according to claim 35 wherein said feeding means includes a conveyor belt which extends to each of said winding stations.

37. A winding station according to claim 35 wherein said switch means is arranged so as to provide for continuous operation of said feeding means during a changeover from a first to a second winding station.

38. A method of producing rolls of bags, comprising winding bags into a roll in one of at least two winding stations, each winding station including a rotational means, without the bags being connected to one another, feeding the bags, one by one, to a rotational means and winding the bags one by one in a spaced arrangement thereon, and directing the bags to another of the winding stations when one roll of bags is completed in one of said at least two winding stations.

39. A method as set forth in claim 36, wherein one of said bags is fully wound onto the rotational means before another one of said bags is engaged with the rotational means.

40. A method as set forth in claim 38, wherein a leading end of each bag is fed into engagement between the periphery of said rotational means which comprises a driven rotating spindle, and a moving belt, which encircles a major portion of the periphery of the spindle.

41. A method as set forth in claim 40, wherein the rotating spindle drives the belt at an essentially constant speed.

42. A method as set forth in claim 40, wherein the tension of the belt is adjusted such that an essentially constant force is applied on the roll of bags being formed between the belt and the periphery of said spindle.

43. A method as set forth in claim 40, wherein the diameter of the spindle is decreased when a roll of bags has been formed thereon, to allow removal of said roll of bags.

44. A method as set forth in claim 38, wherein the bags are produced by feeding a continuous web of bag material, which has perforations or weakened areas in the boundary between adjacent bags, at a web feeding rate to engagement with a driven pair of rollers having a feed rate that exceeds said web feeding rate, thereby separating a bag from said web and providing a spacing thereto.

45. A method as recited in claim 36 wherein said bags are fed by feeding means one by one to said rotational means, and wherein said bags are directed to another of said winding stations by switch means and wherein said switch means is arranged so as to provide for continuous operation of said feeding means during a changeover from a first to a second of said winding stations.

* * * * *

UNITED STATES PATENT AND TRADEMARK OFFICE

CERTIFICATE OF CORRECTION

PATENT NO. : 6,761,329 B2
DATED : July 13, 2004
INVENTOR(S) : Bartels et al.

It is certified that error appears in the above-identified patent and that said Letters Patent is hereby corrected as shown below:

Column 11,
Line 46, after the words "one by one" delete the word "corner" and replace it with -- manner --.

Signed and Sealed this

Twenty-third Day of November, 2004

JON W. DUDAS
*Director of the United States Patent and Trademark Office*